US006009138A

United States Patent [19]

Slusky

[11] Patent Number: 6,009,138

[45] Date of Patent: Dec. 28, 1999

[54] LAP COUNTING

[75] Inventor: Ronald David Slusky, Highland Park, N.J.

[73] Assignee: Lucent Technologies Inc., Murray Hill, N.J.

[21] Appl. No.: 08/911,689

[22] Filed: Aug. 15, 1997

[51] Int. Cl.[6] ..... A63B 71/06

[52] U.S. Cl. ..... 377/5

[58] Field of Search ..... 377/5

[56] References Cited

U.S. PATENT DOCUMENTS 5,125,010 6/1992 Lee et al. ..... 377/5

*Primary Examiner*—Margaret R. Wambach

*Attorney, Agent, or Firm*—Ronald D. Slusky; Kenneth M. Brown

[57] ABSTRACT

A global positioning satellite (GPS) receiver is used in an electronic lap counter which maintains a lap count and which increments the lap count upon "observing" via the GPS receiver that the user, having gone away from an initial "start" location (e.g., an end of a pool or the start line of a closed loop running track), has returned to that location. A user-supplied indication, such as the pressing of a push button, serves as an indication to the lap counter that the lap counter's then current location is to be used as the start location.

8 Claims, 2 Drawing Sheets

| CURRENT LOCATION | DEPART FLAG | \|CL-SL\| | LAP COUNT |
|---|---|---|---|
| SL | 0 | 0 | 000 |
| A | 1 | > Th | 000 |
| X | 1 | > Th | 000 |
| B | 0 | < Th | 001 |
| A | 1 | > Th | 001 |
| X | 1 | > Th | 001 |
| B | 0 | < Th | 002 |
| ⋮ | ⋮ | ⋮ | ⋮ |

LAP COUNTING

BACKGROUND AND SUMMARY OF THE INVENTION

A problem that athletes who "do laps," i.e., run laps around a closed loop running track or swim back and forth in a swimming pool, have is that they lose track of the lap count.

In accordance with the present invention, a global positioning satellite (GPS) receiver is used in an electronic lap counter. The lap counter increments the lap count upon "observing" via the GPS receiver that the user, having gone away from an initial "start" location (e.g., an end of a pool or the start line of a closed loop running track), has returned to that location. A user-supplied indication, such as the pressing of a push button, serves as an indication to the lap counter that the lap counter's then current location is to be used as the start location.

GPS receivers currently available commercially are sufficiently compact that the inventive lap counter can be contained in a housing that may be, for example, carried in a pocket or "fanny pack," or the like, or is strapped onto a belt. However, in the not-too-distant future the size of GPS receivers may well become such that the inventive lap counter can be contained within a wristwatch-like housing or, indeed, could be incorporated into a multi-function watch/lap counter product.

DETAILED DESCRIPTION

Figure 1:
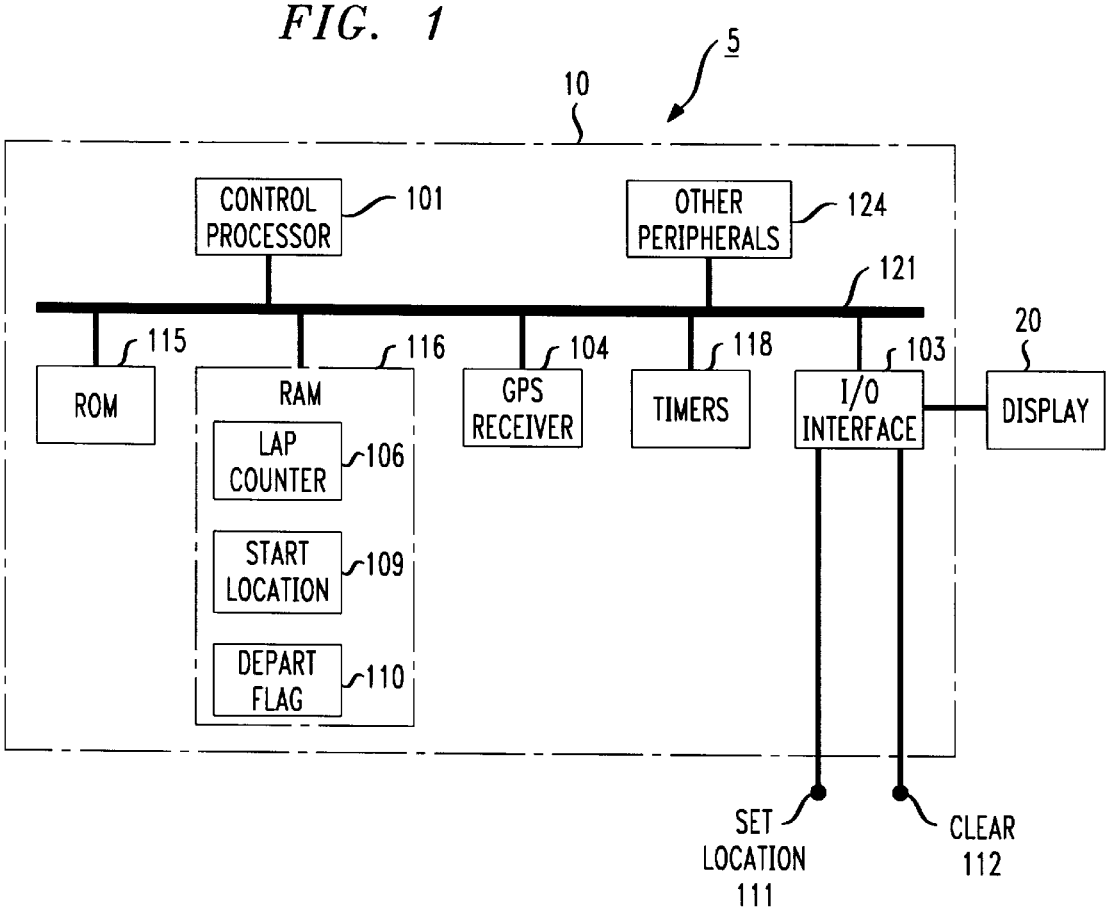
FIG. 1 shows a lap counter embodying the principles of the present invention.
Figure 2:
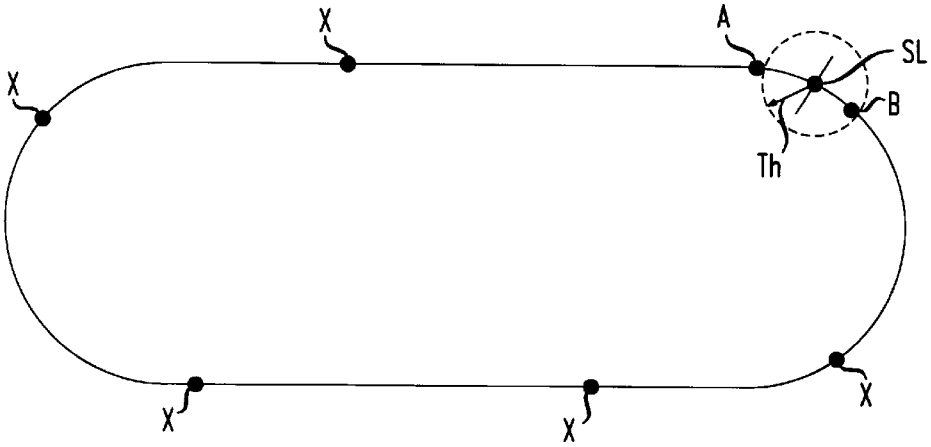
FIG. 2 is a depiction of a running track helpful in explaining the invention.
Figures 3, 4:
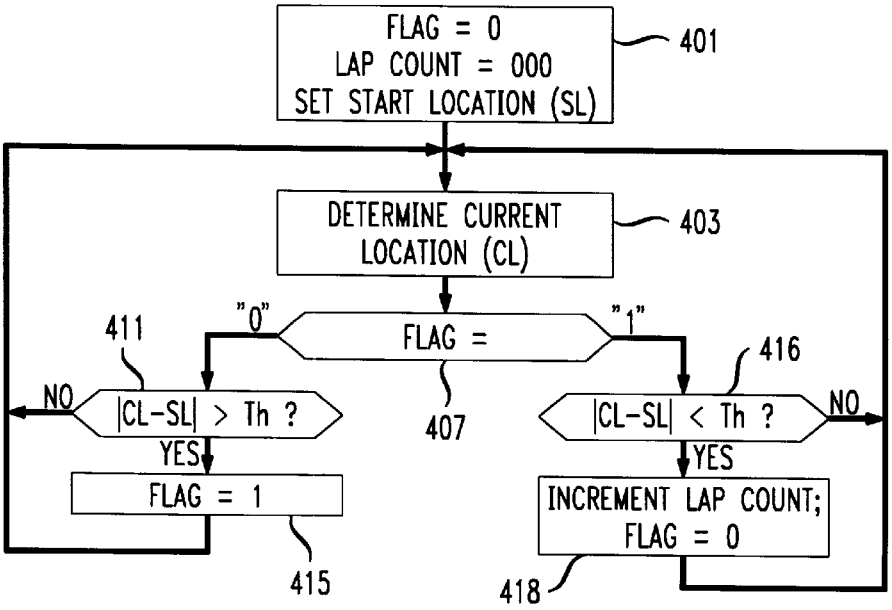
FIG. 3 is a table helpful in explaining the operation of the lap counter of FIG. 1.
FIG. 4 is a flowchart of the operation of the lap counter of FIG. 1

Lap counter 5 shown in the drawing comprises electronics 10 and display 20. Display 20 is a conventional alphanumeric display such as is used in commercially available digital wristwatches. Electronics 10 includes circuitry and programming which keep track of the number of times that a user wearing or carrying the lap counter, having gone away from an initial "start" location (e.g., an end of a pool or the start line of a closed loop running track), has returned to that location, such a going-away-and-return being interpreted as meaning that the user has completed a lap. The accumulated number of laps is caused by electronics 10 to be displayed on display 20. Although not explicitly shown in FIG. 1, electronics 10 may also include circuitry and/or programming which provide other functionalities such as time, stopwatch, calculator, etc.

More particularly, electronics 10 includes control processor 101, which communicates with various peripheral circuits via bus 121. Those peripheral circuits include input/output (I/O) interface 103; GPS receiver 104; read-only memory, or ROM, 115; random access memory, or RAM, 116; timers 118; and various other conventional peripherals represented generically as 124. Within RAM 116 are memory locations serving as registers—namely lap counter register 106, start location register 109 and depart flag register 110. Connected to I/O interface 103 are "set location" button 111 and "clear" button 112. These buttons may be special-purpose buttons whose functionality is limited to the lap counter operation. Alternatively, they may also be used to control time, stopwatch, calculator, or other functions.

The operation of the lap counter may be understood with joint reference to FIGS. 1–4. A user initiates the operation of the lap counter by pressing "set location" button 111. I/O interface 103 communicates to processor 101 the fact that that button was pressed, and processor 101 responds by instructing GPS receiver 104 to output onto bus 121 a "start location" word indicative of the lap counter's current location on the face of the earth—its latitude and longitude—hereinafter referred to as the "location word," GPS receiver 104 contains circuitry capable of determining, using global positioning satellite signals, a location on the face of the earth to a high degree of accuracy, e.g., at least within a matter of meters. GPS receiver 104 is of conventional design and need not be described in further detail.

As indicated in block 401, processor 101 causes the start location or SL, word provided by GPS receiver 104 on bus 121 to be set or stored in start location, register 109, and also clears lap counter register 106 to a count of decimal 000 and sets to "0" the flag stored in depart flag register 110. Processor 101 thereafter, on a periodic basis, e.g., every $1/10^{th}$ second, takes a "sounding" by obtaining a current location, or CL, word from GPS receiver at block 403 and compares it to the start location word stored in start location register 109. Since the flag value is "0", as determined at block 407, a determination is made at block 411 as to whether the magnitude of the distance between the current and start locations, $|CL-SL|$, is greater than a predetermined threshold Th. The magnitude of threshold Th is a function of how accurate GPS receiver 104 is and is equal to an amount which is at least somewhat greater than the GPS receiver margin of error. The condition $|CL-SL|>Th$ illustratively happens when the user—in this case a jogger running on the track shown in FIG. 2—reaches point A, whereupon processor 101, at block 415, sets the depart flag to "1." The fact that the depart flag is set to "1" is indicative of the fact that the user was at the start location and then departed therefrom. The user continues around the track with the user's current location as s/he continues and the track being indicated generically as "x," when $|CL-SL|$ becomes less than Th while the depart flag is set, as determined at block 416, this means that the user, having departed from the start location, has returned. This illustratively happens at Point B. That is, a lap has been completed. Processor 101 thus thereupon, at block 418, increments the count in lap counter register 106 from 000 to 001 and resets the depart flag to "0". When again $|CL-SL|>Th$, the depart flag is again set to "1" at block 415 and when $|CL-SL|$ again becomes $<Th$, as determined at block 416, this means that the user has completed yet another lap and the count in register 106 is incremented to 002. This mode of operation continues until the user depresses "clear" button 112, at which point processor 101 clears display 20 and ceases the above-described lap-counting functionality until "set location" button 11 is again depressed.

Summarizing at this point, it will appreciated that the invention provides a method for updating a lap count maintained by a lap counter via the illustrative steps of utilizing received satellite signals to determine a start location of the lap counter, responsive to an indication from said user—illustratively pressing the "start" button; determining subsequent locations of the lap counter by utilizing further received satellite signals; and incrementing the lap count if the following two criteria are both met: a) at least one of said subsequent locations is substantially different from said start location—meaning, in the embodiment, that |CL-SL|>Th and then b) a later one of said subsequent locations is substantially the same as said start location—meaning, in the embodiment, that |CL-SL|<Th.

In order to ensure accurate operation of the lap counter it may be desirable to a) change the value of the depart flag and b) increment the lap count, only if it is found that |CL-SL| exceeds or is less than Th (as appropriate) over a series of sequential soundings. It may also be found that accuracy in determining that the user has a) departed from the start location and b) returned to the start location, may be enhanced by using first and second different thresholds $Th_1$ and $Th_2$, respectively. That is by using the criterion $|CL-SL|>Th_1$ at block 411 and $|CL-SL|<Th_2$ at block 416.

In the claims hereof, certain recited claim elements are expressed in terms of a means for carrying out a specified function. The invention as defined by such claims resides in the combining of elements which carry out those functions in the way called for in the claims. I thus regard any means which carry out the specified functions as being equivalent to those shown and described herein.

The foregoing merely illustrates the principles of the invention. For example, although the illustrative embodiment uses physical buttons to invoke the functionality of the lap counter, the lap counter might include a microphone and speech recognition circuitry allowing the lap counter to respond to spoken commands such as "start" and "clear." Moreover, although the illustrative embodiment responds to signals from the currently deployed system of satellites comprising the so-called GPS system, the invention is equally useful with any system that may be known now or in the future by which the location of the lap counter can be determined. It will thus be appreciated that those skilled in the art will be able to devise numerous arrangements which, although not explicitly shown or described herein, embody those principles and are within the spirit and scope of the invention.

I claim:

1. Apparatus comprising means for storing in a storage device an indication of a start location of said apparatus, wherein said indication of said start location is representative of an approximate geographic location thereof, and means for incrementing a count upon having made a determination that said apparatus thereafter departed from said start location and then returned thereto.

2. The invention of claim 1 wherein said incrementing means repetitively determines a current location of said apparatus, compares that location to said start location, and makes said determination if a distance between said start location and said current location becomes greater than a first threshold and thereafter becomes less than a second threshold.

3. The invention of claim 2 wherein said first and second thresholds are equal to one another.

4. The invention of claim 3 wherein said means for storing and said means for incrementing jointly include a global positioning satellite receiver.

5. The invention of claim 1 wherein said indication of said start location is representative of an approximate geographic latitude and an approximate geographic longitude thereof.

6. A method for updating a lap count maintained by a lap counter, said method comprising the steps of responsive to an indication from a user, utilizing received satellite signals, to determine a start location of said lap counter, determining subsequent locations of said lap counter utilizing further received satellite signals, and incrementing said lap count if at least one of said determined subsequent locations is substantially different from said start location and at least a later one of said determined subsequent locations is substantially the same as said start location.

7. The invention of claim 6 wherein the criterion that said at least one of said subsequent locations is substantially different from said start location is met if the distance between them exceeds a first threshold, and wherein the criterion that said at least later one of said subsequent locations is substantially the same as said start location is met if the distance between them is less than a second threshold.

8. The invention of claim 7 wherein said first and second thresholds are the same.

* * * * *